US005641228A

United States Patent [19]

Prokopenko

[11] Patent Number: 5,641,228

[45] Date of Patent: Jun. 24, 1997

[54] TRANSDUCER MOUNTING ASSEMBLY

[75] Inventor: Alex V. Prokopenko, Yardville, N.J.

[73] Assignee: Planisol, Inc., Englewood Cliffs, N.J.

[21] Appl. No.: 457,826

[22] Filed: Jun. 1, 1995

[51] Int. Cl.[6] ..... B01F 5/26

[52] U.S. Cl. ..... 366/114; 366/111

[58] Field of Search ..... 366/114, 127, 366/110, 111, 112, 113, 115, 600; 68/355; 134/184, 1

[56] References Cited

U.S. PATENT DOCUMENTS

| | | | |
|---|---|---|---|
| 2,616,820 | 11/1952 | Bourgeaux | 134/1 |
| 2,882,706 | 4/1959 | Brucken | 68/355 |
| 2,932,962 | 4/1960 | Stickel | 68/355 |
| 3,058,014 | 10/1962 | Camp | 134/1 |
| 3,198,489 | 8/1965 | Finch | 134/1 |
| 3,301,535 | 1/1967 | Brown | 366/127 |
| 3,544,073 | 12/1970 | Bodine | 366/113 |
| 3,561,734 | 2/1971 | Antonevich | 366/127 |
| 3,713,729 | 1/1973 | Inoue | 68/355 |
| 5,037,481 | 8/1991 | Bran | 134/184 |

*Primary Examiner*—Robert W. Jenkins
*Attorney, Agent, or Firm*—Richard M. Goldberg

[57] ABSTRACT

An ultrasonic transducer coupling system for fluid materials within a walled container is provided which couples the output of transducers through the wall directly to the fluid and is isolated acoustically from the walls of the container by a soft gasket material, or couples the output of the transducers to the wall of the container by means of bonding material being isolated acoustically from the support bracket outside the container by a soft gasket material.

29 Claims, 4 Drawing Sheets

TRANSDUCER MOUNTING ASSEMBLY

BACKGROUND OF THE INVENTION

This invention relates to transducer mountings, and particularly, to an assembly for attaching transducers to containers for fluids.

The use of ultrasonic transducers with fluids such as solvents in a cleaning tank, molten solder in a tinning pot, and similar liquid systems in a container has been a problem from the standpoint of reliability, energy transfer and assembly methods due to the usual methods of attaching transducers to fluid containers. The usual method now used in this art for attaching transducers to containers is to attach a transducer adhesively or metallurgically to containers of liquids to be vibrated. Adhesive attachments have been lacking in reliability because of their inherent low mechanical endurance limits, thermal stress fracturing and incompatibility with liquid solvents leading to reduced coupling or complete detachment of the transducer or transducers. Metallurgically attached transducers have been found to have a relatively high degree of reliability insofar as attachment is concerned. However, the high brazing or welding temperatures produce warping and incompatibility changes, reducing mechanical endurance limits of the container, and resulting in fatigue and the like.

A method is now known, and embodied in this invention, that eliminates the problems of the prior art discussed hereinabove. Previous inventions couple the output of the transducer or transducers directly to the fluid to be vibrated, with the transducer attachment to the container being at a low particle displacement plane of a composite transducer, by mechanically sandwiching the container wall at the plane desired. The disadvantage of this method is that the direct attachment causes the wall of the container to vibrate. The lower frequency harmonics of the wall oscillation reduces the efficiency of the ultrasonic transducer, and thereby results in a waste of energy.

SUMMARY OF THE INVENTION

In accordance with the present invention, a container has a perforation in the wall, wherein the transducer is mounted in the perforation by means of a soft sealing gasket that isolates the transducer acoustically from the wall of the container. This method raises the efficiency of the transducer, conserves energy and eliminates the vibration in the container. As a result, containers can be made from various materials, i.e. glass, ceramic, plastic, wood or metal.

In applications where a perforation in the container wall is not desirable, a mounting support bracket is provided. The transducer is similarly mounted using a gasket to isolate the transducer to provide the same advantages described previously. However, in this case, the transducer providing the energy to vibrate the fluid, is bonded to the base of the container.

The mounting bracket provides support to the transducer which prevents detachment from the wall, but does not dampen the oscillation. This, in turn, raises the reliability factor and again permits use of many various container materials. Should a plastic container be used, its flexibility does not affect the bonding of the transducer because the support bracket adds stiffness to the whole container without loss of energy or efficiency.

In the foregoing general description, certain objects, purposes and advantages of the present invention have been set out. Other objects, purposes and advantages will become apparent, i.e. placing the system inside a waterproof box and submerging the entire box in a liquid filled container.

BRIEF DESCRIPTION OF THE DRAWINGS

Consider the following description and accompanying drawings in which.

DETAILED DESCRIPTION OF THE PREFERRED EMBODIMENTS

Figure 1A:
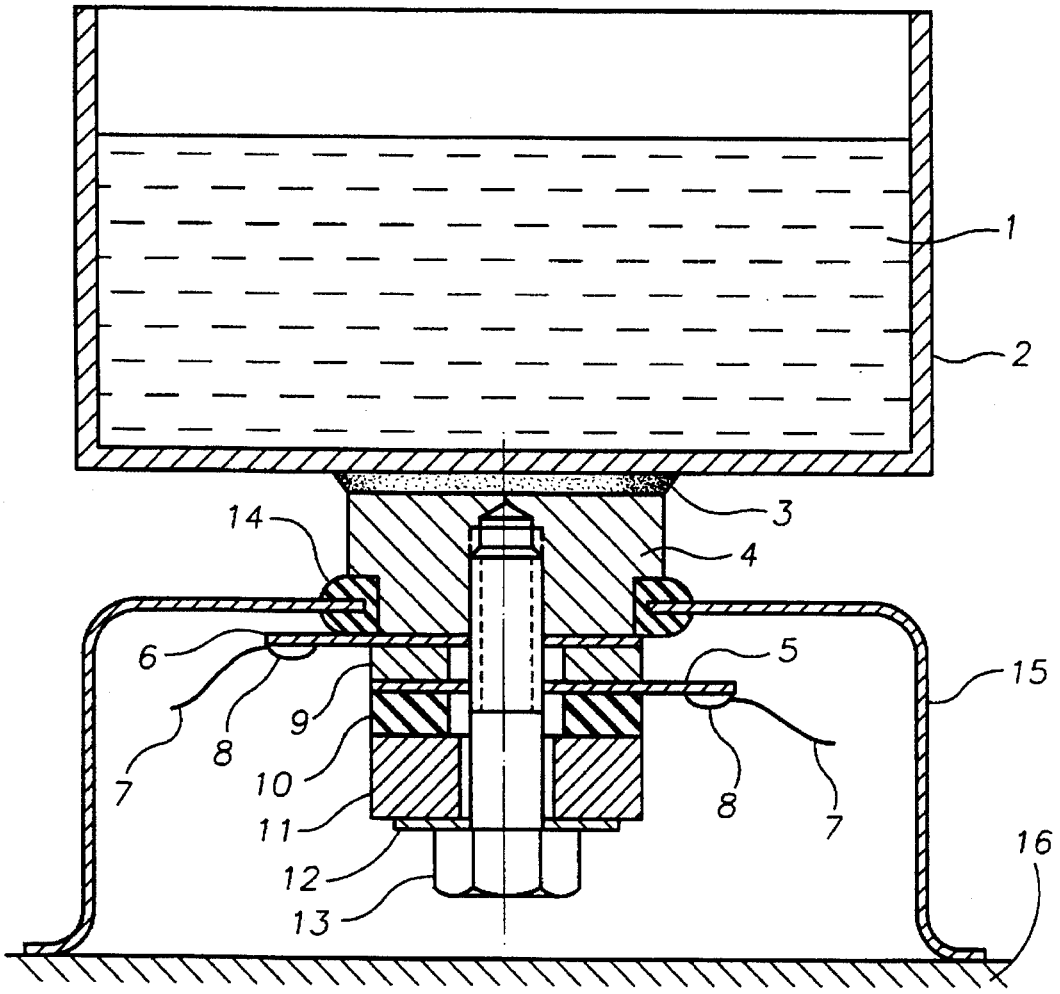
FIG. 1A is a vertical cross-sectional view of a container with liquid according to a first embodiment of the invention, including a mounting bracket and soft gasket installation, when bonding is used to attach a transducer or transducers to the container.
Figure 1B:
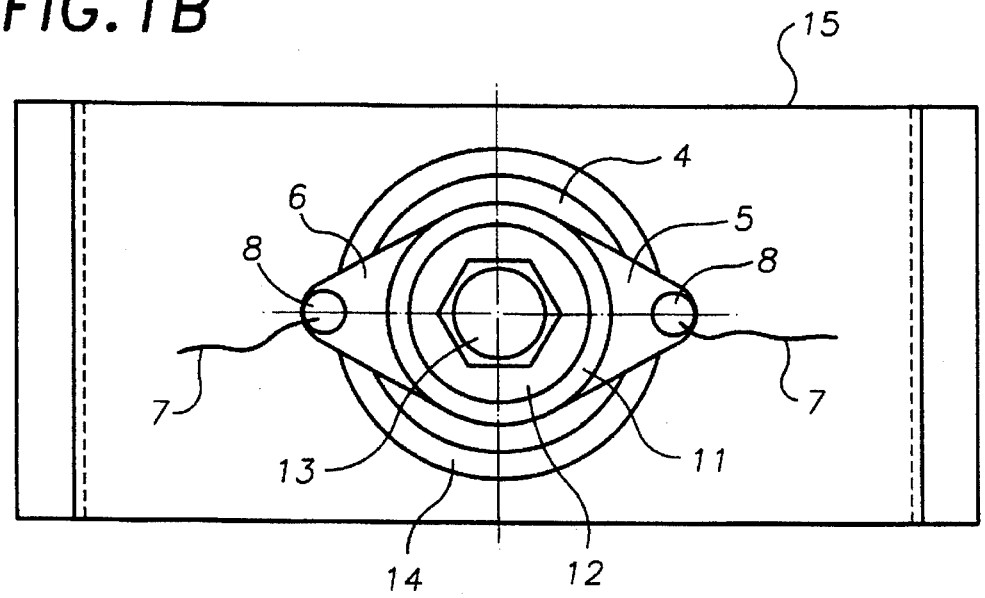
FIG. 1B is a bottom plan view of the assembly of FIG. 1A.

Referring to the drawings, and initially to FIGS. 1A and 1B, for use with a transducer assembly according to a first embodiment of the invention, a liquid 1 is poured into a container 2. A bonding layer 3 attaches a transducer mass 4 to the bottom wall of container 2. A hot electrode 5, ground electrode 6, both with wires 7 attached by solder 8, piezoelectric ring 9, insulator 10, and second transducer mass 11 are assembled into a sandwich type transducer by a spring washer 12 and bolt 13, and connected to transducer mass 4. To make the bonding connection reliable and to overcome any flexibility of the container base, the transducer assembly is supported by a soft gasket 14 and spring bracket 15, installed on a rigid platform 16. Soft gasket 14 and bracket 15 allow the transducer assembly to vibrate and also compensate for the static weight of liquid 1 and the entire container 2. In this way, the bottom wall is not deflected and bonding layer 3 is not subjected to strenuous deflections or deformations.

Figure 2:
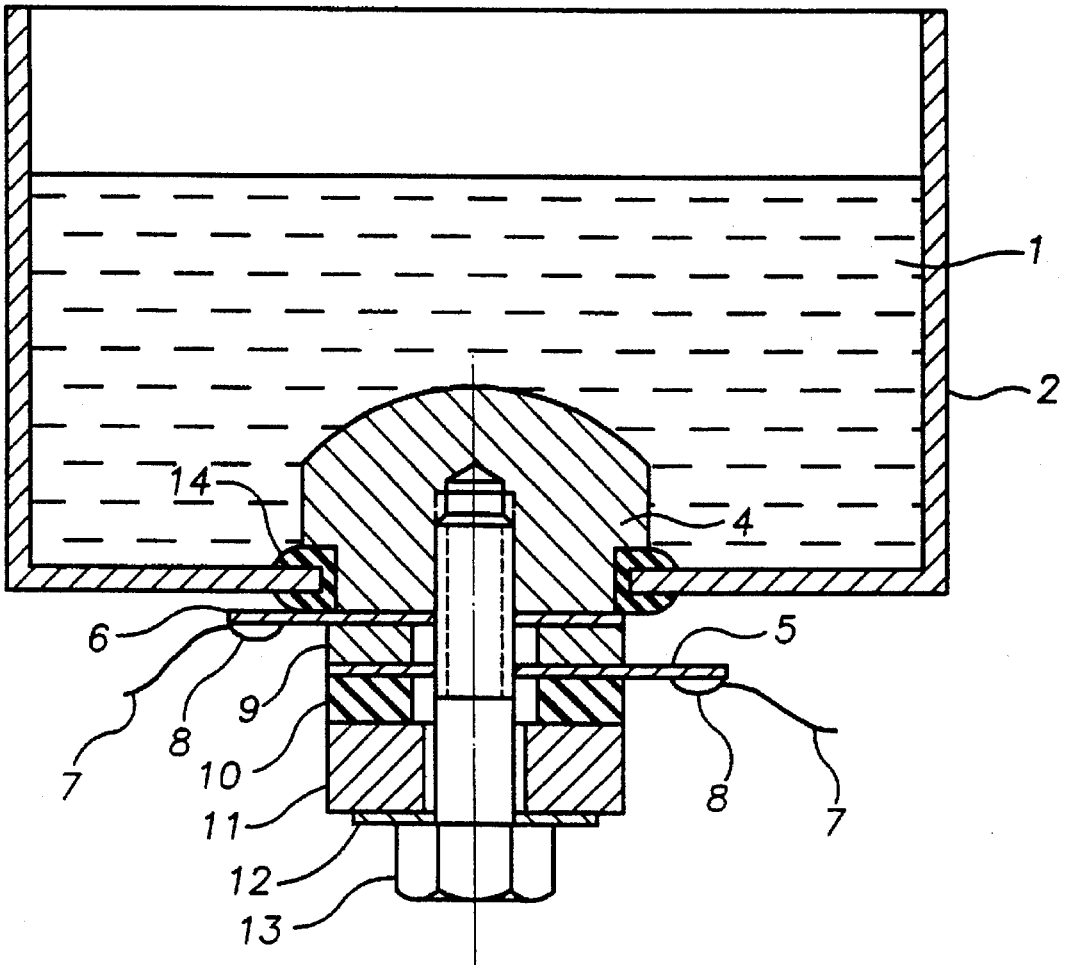
FIG. 2 is a vertical cross-section of a container with liquid according to a second embodiment of the invention, showing the soft gasket installation when a transducer or transducers have direct contact with the liquid.

In FIG. 2, the shape of the front surface of mass 4 is spherical in order to generate a wide display of radiating sound waves into liquid 1. To alter the display, the shape of mass 4 can be changed.

In either design depicted in FIGS. 1A, 1B and FIG. 2, the piezoelectric element can be interchanged with a magnetostrictive transducer.

In FIG. 2, a transducer or transducers are mounted to a container 2 with liquid 1 in which the sandwich type transducer is in direct contact with liquid 1. The sandwich type transducer includes a mass 4, electrodes 5, 6 with wires 7 soldered by solder 8, piezoelectric ring 9, insulator 10, and mass 11, assembled by a spring washer 12 and a compression bolt 13. The transducer assembly is mounted in a perforation of container 2 and sealing is effected with a soft gasket 14. The sealing gasket 14 prevents liquid leakage and isolates the transducer sandwich 4, 5, 6, 7, 8, 9, 10, 11, 12 and 13 from transmitting vibrations to the walls of container 2.

Figure 3:
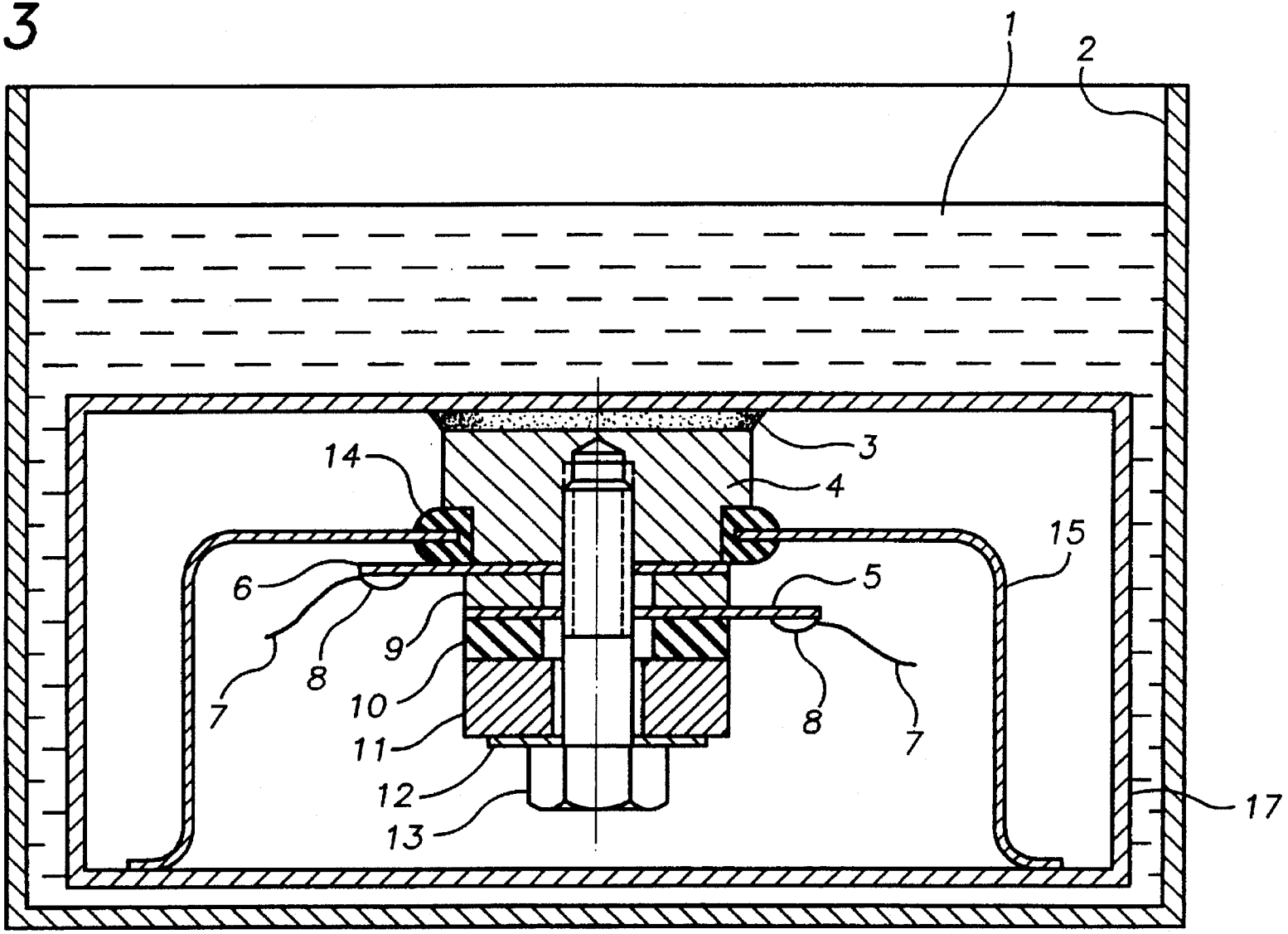
FIG. 3 is a vertical cross-section of a container with liquid according to a third embodiment of the present invention, which is similar to FIG. 1A, but showing the assembly placed inside a waterproof box and submerging the entire box in a liquid filled container.

FIG. 3 shows an arrangement similar to FIG. 1A, except that the transducer assembly is placed inside a waterproof box 17 and the entire box 17 is submerged in a liquid filled container. In this case, box 17 rests on the bottom wall of container 2, and the transducer assembly is bonded to the top wall of box 17.

Figure 4:
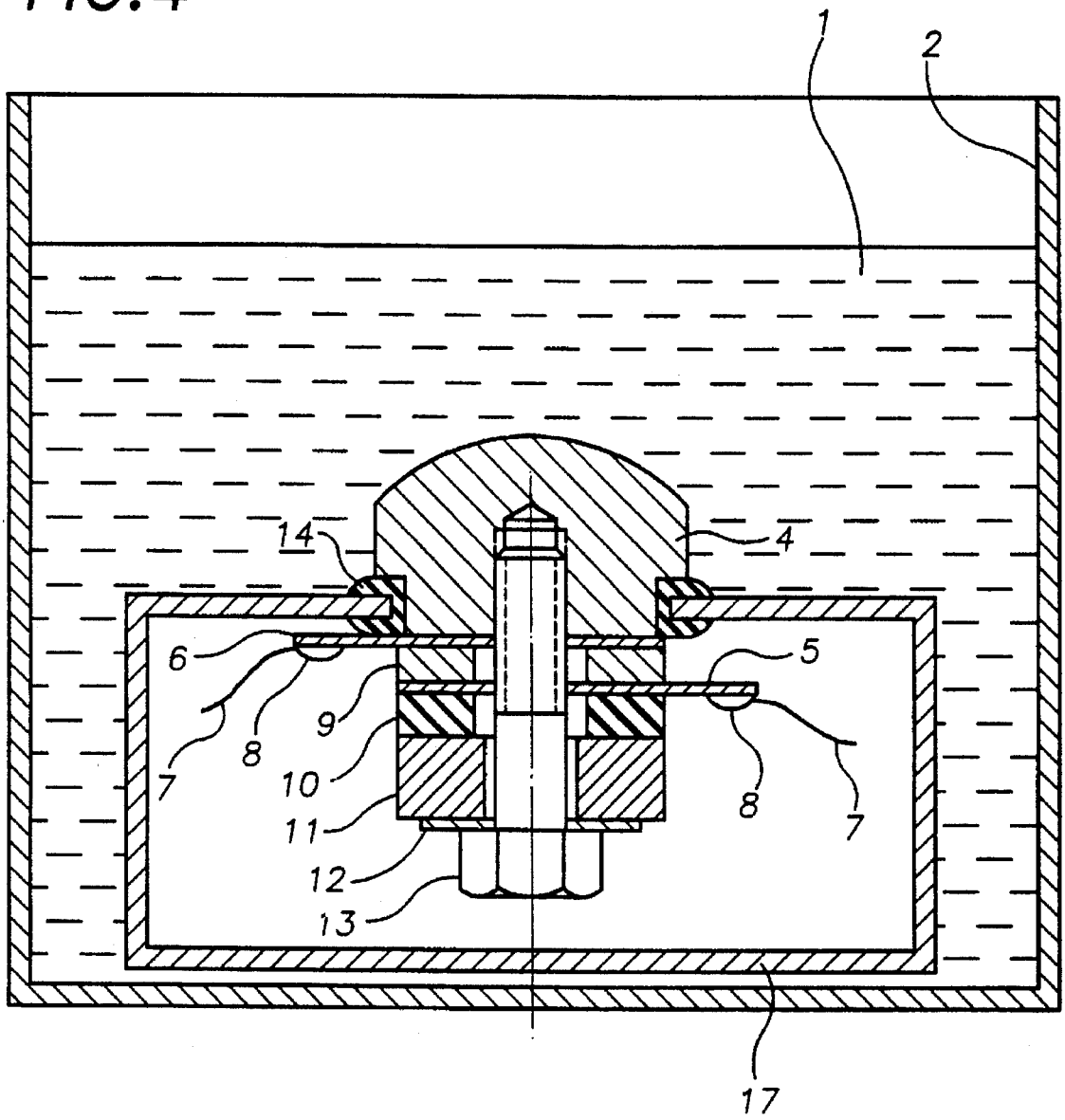
FIG. 4 is a vertical cross-sectional view of a container with liquid according to a fourth embodiment of the present invention, which is similar to FIG. 2, but showing the assembly placed inside a waterproof box and submerging the entire box in a liquid filled container.

FIG. 4 shows an arrangement similar to FIG. 2, except that the transducer assembly is placed inside waterproof box 17 and the entire box 17 is submerged in a liquid filled container. In this case, box 17 rests on the bottom wall of container 2, and the transducer assembly is bonded to the top wall of box 17.

I claim:

1. A transducer mounting assembly for a transducer assembly secured to an outer surface of a wall of a container filled with a liquid, without the transducer assembly extending through an opening in the wall, comprising:

a gasket secured to and at least partially surrounding the transducer assembly; and a spring member for providing support to the transducer assembly to prevent detachment of the transducer assembly from the outer surface of the wall of the container without dampening oscillations of the transducer assembly, said spring member having an upper portion secured to said gasket and a lower portion which is positioned lower than a lowest point of said transducer assembly for engaging a support surface.

2. A transducer mounting assembly according to claim 1, wherein said spring member includes a bent bracket.

3. A transducer mounting assembly according to claim 2, wherein said transducer assembly is secured within a central portion of said bent bracket.

4. A transducer mounting assembly according to claim 2, wherein said bracket has a substantially inverted U-shaped configuration in cross-section.

5. A transducer mounting assembly according to claim 1, wherein said gasket is made from a material selected from the group consisting of polytetrafluoroethylene, silicone, neoprene, EPDM, rubber, delran and plastic.

6. A transducer mounting assembly according to claim 1, wherein said transducer assembly includes a sandwich construction formed of a first transducer mass, a ground electrode, a piezoelectric ring, a hot electrode, an insulator and a second transducer mass secured together, with said first transducer mass being secured to the outer surface of the wall of the container.

7. A transducer mounting assembly according to claim 6, wherein said gasket is secured to the first transducer mass.

8. A combination of a transducer mounting assembly and a transducer assembly to be secured to an outer surface of a wall of a container filled with a liquid, without the transducer assembly extending through an opening in the wall, comprising:

a transducer assembly;

a gasket secured to and at least partially surrounding said transducer assembly; and a spring member for providing support to the transducer assembly to prevent detachment of the transducer assembly from the outer surface of the wall of the container without dampening oscillations of the transducer assembly, said spring member having an upper portion secured to said gasket and a lower portion which is positioned lower than a lowest point of said transducer assembly for engaging a support surface.

9. A transducer mounting assembly according to claim 8, wherein said spring member includes a bent bracket.

10. A transducer mounting assembly according to claim 9, wherein said transducer assembly is secured within a central portion of said bent bracket.

11. A transducer mounting assembly according to claim 9, wherein said bracket has a substantially inverted U-shaped configuration in cross-section.

12. A transducer mounting assembly according to claim 8, wherein said gasket is made from a material selected from the group consisting of polytetrafluoroethylene, silicone, neoprene, EPDM, rubber, delran and plastic.

13. A transducer mounting assembly according to claim 8, wherein said transducer assembly includes a sandwich construction formed of a first transducer mass, a ground electrode, a piezoelectric ring, a hot electrode, an insulator and a second transducer mass secured together, with said first transducer mass being secured to the outer surface of the wall of the container.

14. A transducer mounting assembly according to claim 13, wherein said gasket is secured to the first transducer mass.

15. A transducer mounting assembly for a transducer assembly secured to an inner surface of an upper wall of a box which is positioned in a container filled with a liquid, without the transducer assembly extending through an opening in the upper wall, comprising:

a gasket secured to and at least partially surrounding the transducer assembly; and a spring member for providing support to the transducer assembly to prevent detachment of the transducer assembly from the inner surface of the upper wall of the box without dampening oscillations of the transducer assembly, said spring member having an upper portion secured to said gasket and a lower portion which is positioned lower than a lowest point of said transducer assembly for engaging an inner surface of a lower wall of said box.

16. A transducer mounting assembly according to claim 15, wherein said spring member includes a bent bracket.

17. A transducer mounting assembly according to claim 16, wherein said transducer assembly is secured within a central portion of said bent bracket.

18. A transducer mounting assembly according to claim 16, wherein said bracket has a substantially inverted U-shaped configuration in cross-section.

19. A transducer mounting assembly according to claim 15, wherein said gasket is made from a material selected from the group consisting of polytetrafluoroethylene, silicone, neoprene, EPDM, rubber, delran and plastic.

20. A transducer mounting assembly according to claim 15, wherein said transducer assembly includes a sandwich construction formed of a first transducer mass, a ground electrode, a piezoelectric ring, a hot electrode, an insulator and a second transducer mass secured together, with said first transducer mass being secured to the inner surface of the upper wall of the container.

21. A transducer mounting assembly according to claim 20, wherein said gasket is secured to the first transducer mass.

22. A transducer mounting assembly according to claim 20, wherein said box is water-tight.

23. A combination of a transducer mounting assembly and a transducer assembly, comprising:

a box for seating within a container filled with a liquid, said box having an upper wall and a lower wall;

a transducer assembly secured to an inner surface of said upper wall of said box, without extending through an opening in the upper wall;

a gasket secured to and at least partially surrounding said transducer assembly; and a spring member for providing support to the transducer assembly to prevent detachment of the transducer assembly from the inner surface of the upper wall of the box without dampening oscillations of the transducer assembly, said spring member having an upper portion secured to said gasket and a lower portion which is positioned lower than a lowest point of said transducer assembly for engaging an inner surface of the lower wall of said box.

24. A transducer mounting assembly according to claim 23, wherein said spring member includes a bent bracket.

25. A transducer mounting assembly according to claim 24, wherein said transducer assembly is secured within a central portion of said bent bracket.

26. A transducer mounting assembly according to claim 24, wherein said bracket has a substantially inverted U-shaped configuration in cross-section.

27. A transducer mounting assembly according to claim 23, wherein said gasket is made from a material selected from the group consisting of polytetrafluoroethylene, silicone, neoprene, EPDM, rubber, delran and plastic.

28. A transducer mounting assembly according to claim 23, wherein said transducer assembly includes a sandwich construction formed of a first transducer mass, a ground electrode, a piezoelectric ring, a hot electrode, an insulator and a second transducer mass secured together, with said first transducer mass being secured to the outer surface of the wall of the container.

29. A transducer mounting assembly according to claim 28, wherein said gasket is secured to the first transducer mass.

* * * * *